US008529381B2

(12) United States Patent
Solheim et al.

(10) Patent No.: US 8,529,381 B2
(45) Date of Patent: Sep. 10, 2013

(54) DIVOT TOOLS AND METHODS OF MAKING DIVOT TOOLS

(75) Inventors: John A. Solheim, Phoenix, AZ (US); Eric V. Cole, Phoenix, AZ (US); Jake Fife, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/315,673

(22) Filed: Dec. 9, 2011

(65) Prior Publication Data

US 2013/0095958 A1 Apr. 18, 2013

Related U.S. Application Data

(60) Provisional application No. 61/547,246, filed on Oct. 14, 2011.

(51) Int. Cl.
*A63B 57/00* (2006.01)

(52) U.S. Cl.
USPC ..... 473/408

(58) Field of Classification Search
USPC ..... 473/408, 406, 285, 286; D21/793; 224/918
See application file for complete search history.

(56) References Cited

U.S. PATENT DOCUMENTS

| | | | | | |
|---|---|---|---|---|---|
| 3,298,579 | A | * | 1/1967 | Smith | 224/918 |
| 3,339,300 | A | * | 9/1967 | Bury | 224/918 |
| 3,618,673 | A | * | 11/1971 | Gossett | 473/408 |
| 3,620,426 | A | | 11/1971 | Hatch | |
| 3,866,749 | A | | 2/1975 | Stainer | |
| 4,974,842 | A | * | 12/1990 | Widman | 473/406 |
| 4,984,790 | A | * | 1/1991 | Dowdy et al. | 473/408 |
| 5,022,650 | A | * | 6/1991 | Madock | 473/408 |
| 5,121,519 | A | * | 6/1992 | Haugom | 473/408 |
| 5,305,999 | A | | 4/1994 | Tate | |
| 5,393,052 | A | * | 2/1995 | Kennedy | 473/285 |
| 5,733,208 | A | * | 3/1998 | Fazekas | 473/406 |
| 5,788,197 | A | | 8/1998 | Tutela | |
| 5,795,248 | A | * | 8/1998 | Giglio | 473/406 |
| 6,004,229 | A | * | 12/1999 | Fazekas | 473/406 |
| 6,030,298 | A | * | 2/2000 | Tate | 473/408 |
| 6,033,322 | A | * | 3/2000 | England | 473/408 |
| D425,597 | S | * | 5/2000 | Bato | D21/793 |
| 6,224,502 | B1 | * | 5/2001 | Warfield | 473/408 |
| 6,820,282 | B1 | * | 11/2004 | England et al. | 2/161.1 |
| 6,939,254 | B2 | * | 9/2005 | Tiefel | 473/408 |
| 7,226,370 | B1 | * | 6/2007 | Cope | 473/406 |
| 7,238,126 | B1 | * | 7/2007 | Wiens et al. | 473/408 |
| 7,611,426 | B1 | * | 11/2009 | Bradshaw | 473/408 |
| 7,766,769 | B2 | * | 8/2010 | Lueders | 473/408 |
| D666,265 | S | * | 8/2012 | Solheim et al. | D21/793 |
| 2006/0183569 | A1 | * | 8/2006 | Shwartz et al. | 473/406 |
| 2007/0111826 | A1 | * | 5/2007 | Blanks | 473/408 |
| 2008/0268985 | A1 | * | 10/2008 | Wiens et al. | 473/408 |
| 2011/0201456 | A1 | * | 8/2011 | Schaaf | 473/408 |
| 2011/0312447 | A1 | * | 12/2011 | Light | 473/408 |
| 2012/0135821 | A1 | * | 5/2012 | Boyd et al. | 473/342 |
| 2012/0135824 | A1 | | 5/2012 | Bohannon | |

FOREIGN PATENT DOCUMENTS

| | | | |
|---|---|---|---|
| GB | 2472862 | A | 2/2011 |

* cited by examiner

*Primary Examiner* — Steven Wong

(57) ABSTRACT

Embodiments of divot tools having ball markers and methods of making divot tools are generally described herein. Other embodiments may be described and claimed.

14 Claims, 8 Drawing Sheets

DIVOT TOOLS AND METHODS OF MAKING DIVOT TOOLS

CROSS-REFERENCE TO RELATED APPLICATIONS

The present application claims the benefit of U.S. Provisional Patent Application Ser. No. 61/547,246, filed Oct. 14, 2011, the entire disclosure of which is incorporated herein by reference.

FIELD

The present application generally relates to divot tools, and more particularly, to divot tools having ball markers and methods of making divot tools.

BACKGROUND

When a golf ball is hit with a golf club and lands on the green the golf ball may create a depression or a divot on the green A divot tool may be used to repair a divot. A divot tool typically has two spaced apart barbs. To repair a divot, an individual inserts the barbs into the green at one or more locations around the divot, and pushes the green that is between the barbs and the divot toward the divot. The green around the divot that is pushed into the pivot promotes root growth inside the divot and over a period of time causes the green to fill the divot.

DETAILED DESCRIPTION

Figure 1:
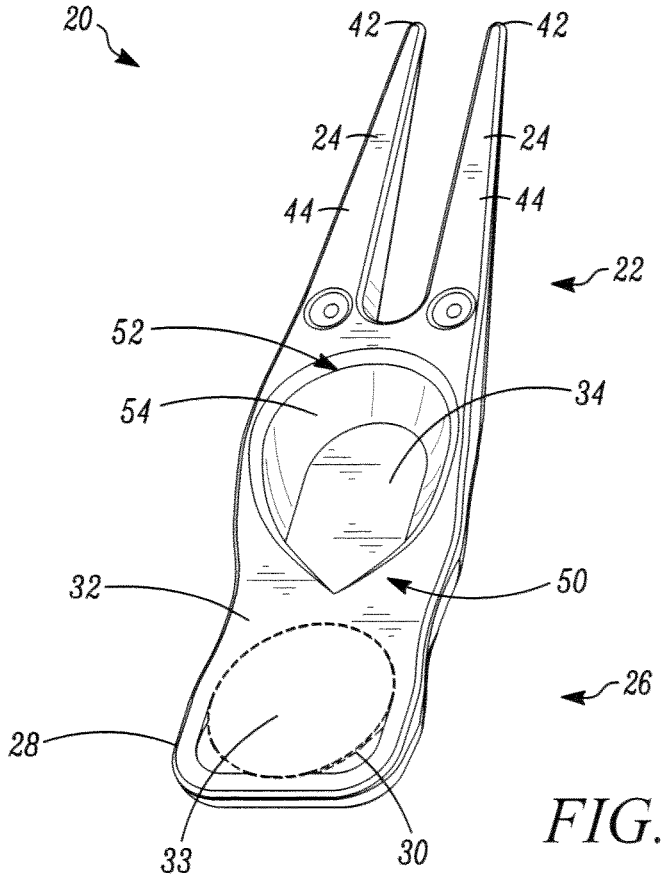
FIG. 1 is a top perspective view of a divot tool according to one embodiment.
Figure 2:
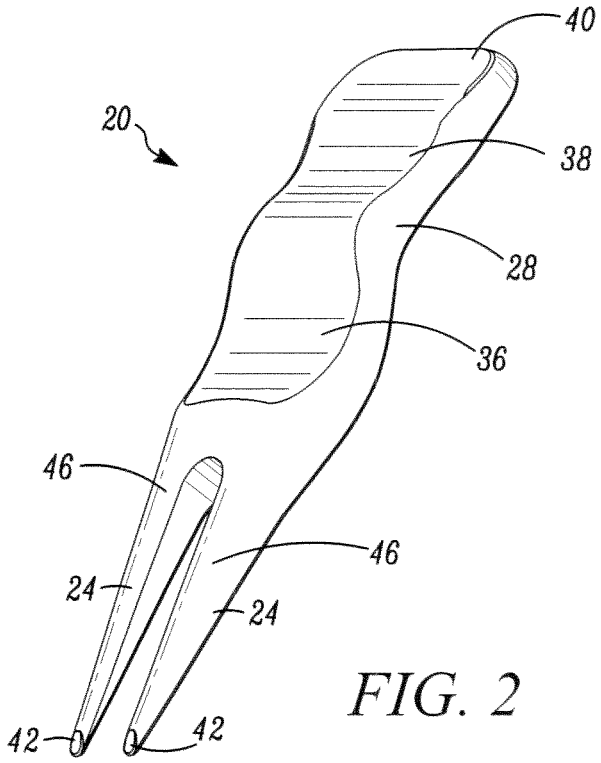
FIG. 2 is a bottom perspective view of the divot tool of FIG. 1.

Referring to FIGS. 1-8, a divot tool 20 according to an exemplary embodiment is shown. The divot tool 20 includes a first portion 22 having one or more barbs, generally shown as 24, for insertion into the green to repair a divot and a second portion 26, which includes a ball marker recess 30 on a first side 32 (shown in FIGS. 1 and 3) of the divot tool 20 for receiving and holding a ball marker 33. The second portion 26 includes a first finger recess 34 on the first side 32 and second and third finger recesses 36 and 38, respectively, on a second side 40 (shown in FIGS. 2 and 4) of the divot tool 20. All of the above-noted features of the divot tool 20 and functions thereof are described in detail in the following.

Each of the barbs 24 is tapered and has a generally pointed end 42 to facilitate insertion of the barb 24 into the green with relative ease. Each barb 24 may be cone or wedge shaped. However, each barb 24 may have other symmetrical or asymmetrical shapes that provide tapering from a larger cross section to a smaller cross section or to a generally pointed end. In the exemplary embodiment shown in FIGS. 1-8, each barb 24 has a flat side 44 on the first side 32 of the divot tool 20 and a sloped side 46 on the second side 40 of the divot tool 20. As the barb 24 is inserted and advanced into the green, the sloped side 46 may cause the barb 24 to slightly tilt toward the divot, thereby pushing the green surrounding the divot into the divot to assist with the divot repair process.

Figure 3:
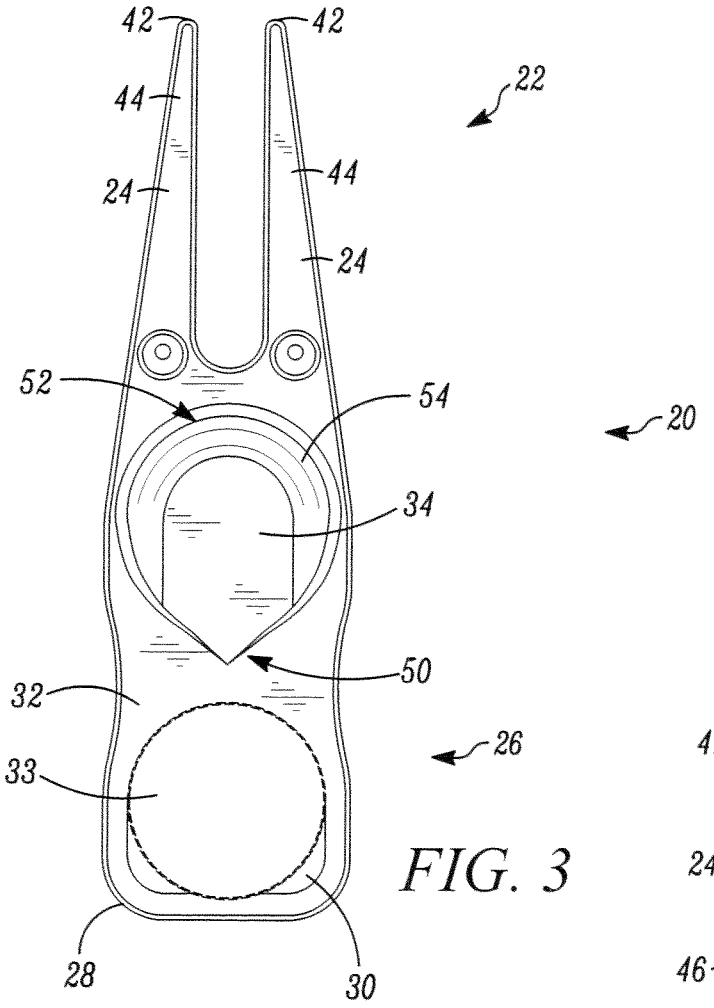
FIG. 3 is a top view of the divot tool of FIG. 1.
Figure 4:
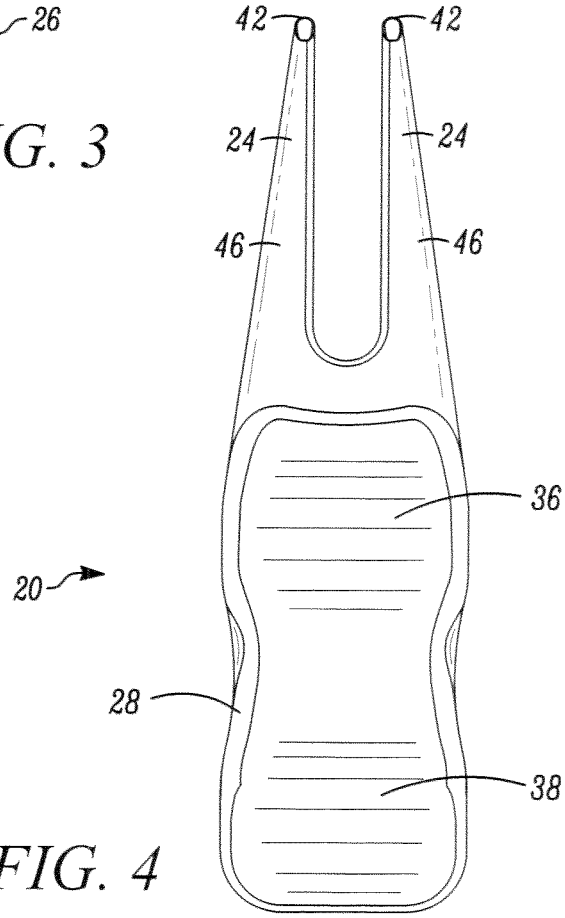
FIG. 4 is a bottom view of the divot tool of FIG. 1.
Figure 5:
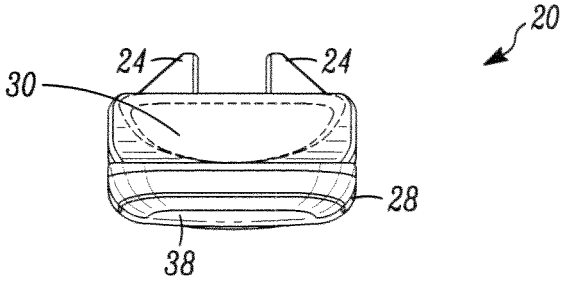
FIG. 5 shows the divot tool of FIG. 1 as viewed from one end of the divot tool.
Figure 6:
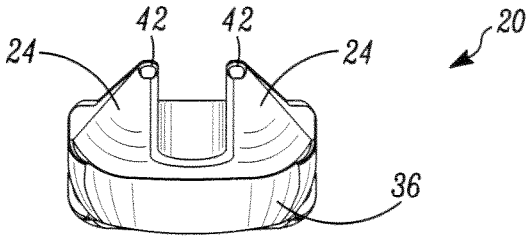
FIG. 6 shows the divot tool of FIG. 1 as viewed from an end of the divot tool that is opposite to the end shown in FIG. 5.
Figure 7:
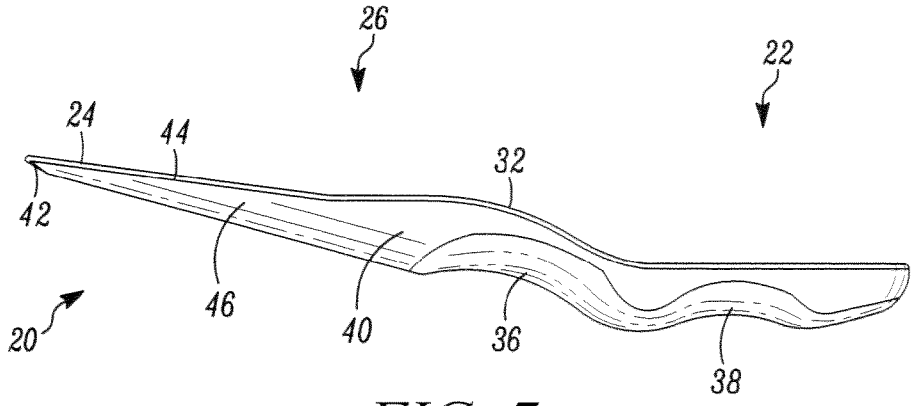
FIG. 7 is a side view of the divot of FIG. 1.

The first finger recess 34 is on the first side 32 of the divot tool 20. The first finger recess 34 may be sized to receive the distal phalange of an individual's thumb while the individual is holding the divot tool 20. To accommodate different thumb sizes, the first finger recess 34 may be sized to receive a large-sized thumb, thereby also accommodating individuals with small-sized thumbs. The first finger recess 34 may have a flat bottom or a curved bottom. In the exemplary embodiments shown in FIGS. 1 and 3, the depth of the first finger recess 34 increases from the first end 50 of the first finger recess 34 toward the second end 52 of the first finger recess 34. The second end 52 includes a sharply sloped wall 54. The sharply sloped wall 54 may be nearly vertical or completely vertical relative to the bottom of the first finger recess 34. The height of the wall 54 is configured to be similar or greater than the thickness or the width of the tip of an individual's thumb. Accordingly, when an individual's thumb is located in the first finger recess 34 during insertion of the divot tool 20 into the green, the tip of the individual's thumb presses against the wall 54 and is prevented from slipping out of the first finger recess 34. The varying depth of the first finger recess 34 from the first end 50 to the second end 52 creates an inclined surface relative to the first end 50 and the second end 52 that can provide proper placement of an individual's thumb in the first finger recess 34 so that the tip of the individual's thumb strikes the wall 54 as described. For example, if an individual places his thumb in the first finger recess 34 without the tip of his thumb contacting the wall 54, upon initiating the insertion of the barbs 24 into the green, the individual's thumb slides in the first finger recess 34 toward the wall 54 until the tip of his thumb strikes the wall 54. The varying depth of the first finger recess 34 also ergonomically supports the distal phalange of the thumb when the divot tool 20 is held by an individual. To provide the noted ergonomic support, the first finger recess 34 may have a generally oval shape or a generally tear drop shape as shown in FIGS. 1 and 3. Accordingly, the widest part of the first finger recess 34 may be near the second end 52 with the first finger recess 34 narrowing in width toward the first end 50.

The second side 40 of the divot tool 20 includes the second finger recess 36 and the third finger recess 38 for receiving the index finger and the middle finger, respectively, of an individual when using the divot tool 20 for divot repair. However, depending on the individual's preference in holding the divot tool and/or depending on the size of the individual's hands, the individual may use any two fingers of his hand for placement in the finger recesses 36 and 38. The finger recesses 36 and 38 are formed by inwardly curved surfaces or concave depressions on the second side 40 of the divot tool 20 and are sized and shaped to be generally compatible with the fingers of any individual using the divot tool 20. The finger recesses 36 and 38 provide a frictional grip for an individual holding the divot tool 20. Furthermore, the locations of the finger recesses 36 and 38 on the divot tool 20 may ensure correct placement of an individual's fingers on the divot tool 20 when gripping the divot tool 20.

When holding divot tool 20 for a divot repair process, an individual grips the divot tool 20 with his left or right hand by placing his thumb in the first finger recess 34, his index finger in the second finger recess 36 and his middle finger in the third finger recess 38. Thus, the second portion 22, which includes the first finger recess 34 and the finger recesses 36 and 38 functions as a handle for the divot tool 20 during a divot repair process. When inserting the barbs 24 into the green, the wall 54 of the first finger recess 34 prevents the individual's thumb from slipping out and allows the individual to push downward. The index and middle fingers wrap around the second portion 26 and also assist in pushing downward. The finger recesses 36 and 38 reduce the possibility of the index and middle fingers slipping on the second side 40 of the divot tool 20. Thus, the first finger recess 34 and the finger recesses 36 and 38 assist in preventing the individual's thumb and fingers from slipping on the divot tool 20 while inserting the barbs 24 into the green. When repairing the divot, an individual uses his index and middle fingers to push the barbs 24 toward the divot, thereby pushing the green surrounding the divot into the divot. During this movement, the thumb in the first finger recess 34 provides a counter force to stabilize and control the pushing motion created by the index and middle fingers and to assist in rotationally moving the divot tool 20 if necessary. The thumb pressing down on the divot tool 20 also maintains the barbs 24 in the green during the divot repair process. The first finger recess 34 also assists in preventing the thumb from slipping out of the first finger recess 34 after insertion of the barbs 24 into the ground and during the divot repair process.

Figure 8:
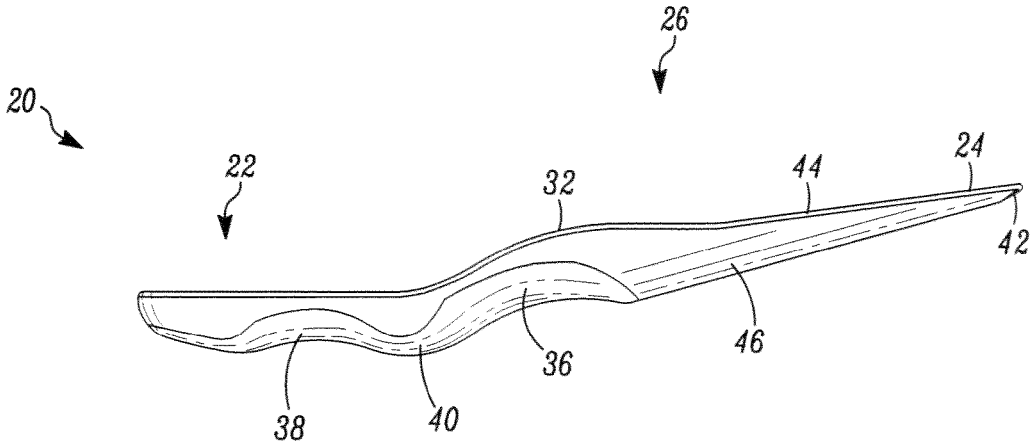
FIG. 8 shows the divot tool of FIG. 1 as viewed from another side of the divot tool that is opposite to the side shown in FIG. 7.
Figure 9:
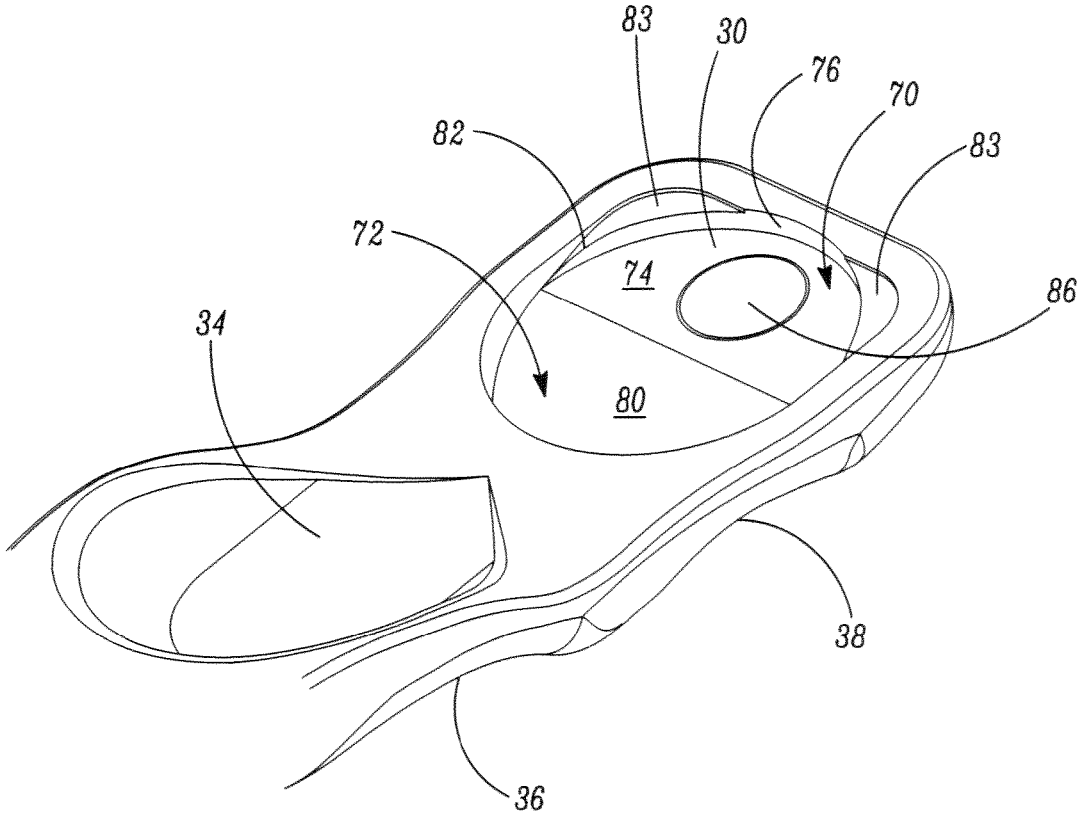
FIG. 9 is a side perspective view of a section of the divot tool of FIG. 1.
Figure 10:
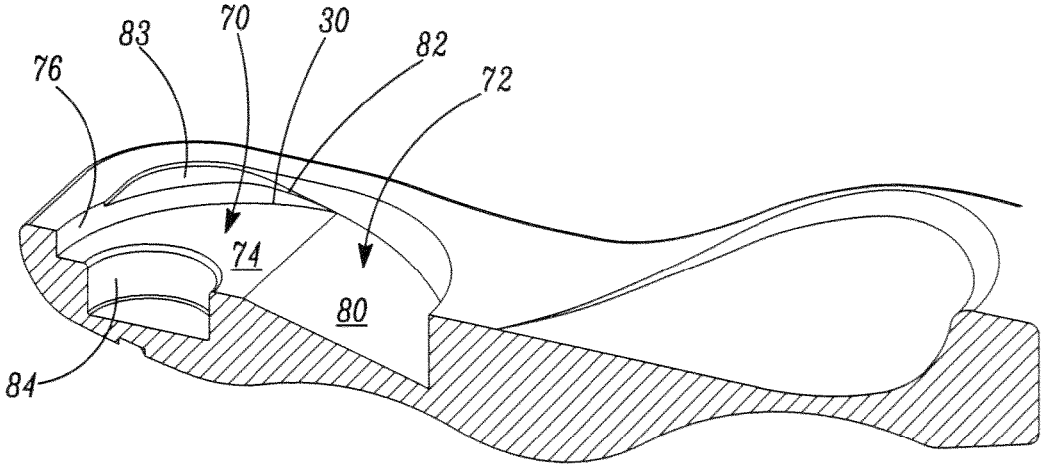
FIG. 10 is perspective cutaway view of a ball marker recess of a divot tool according to one embodiment.
Figure 11:
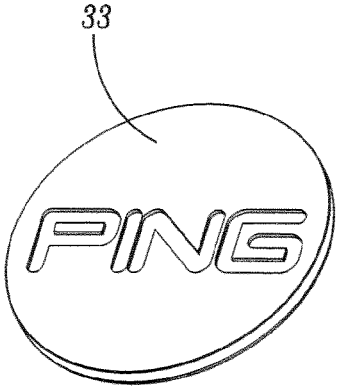
FIG. 11 is a perspective view of a ball marker according to one embodiment.
Figure 13:
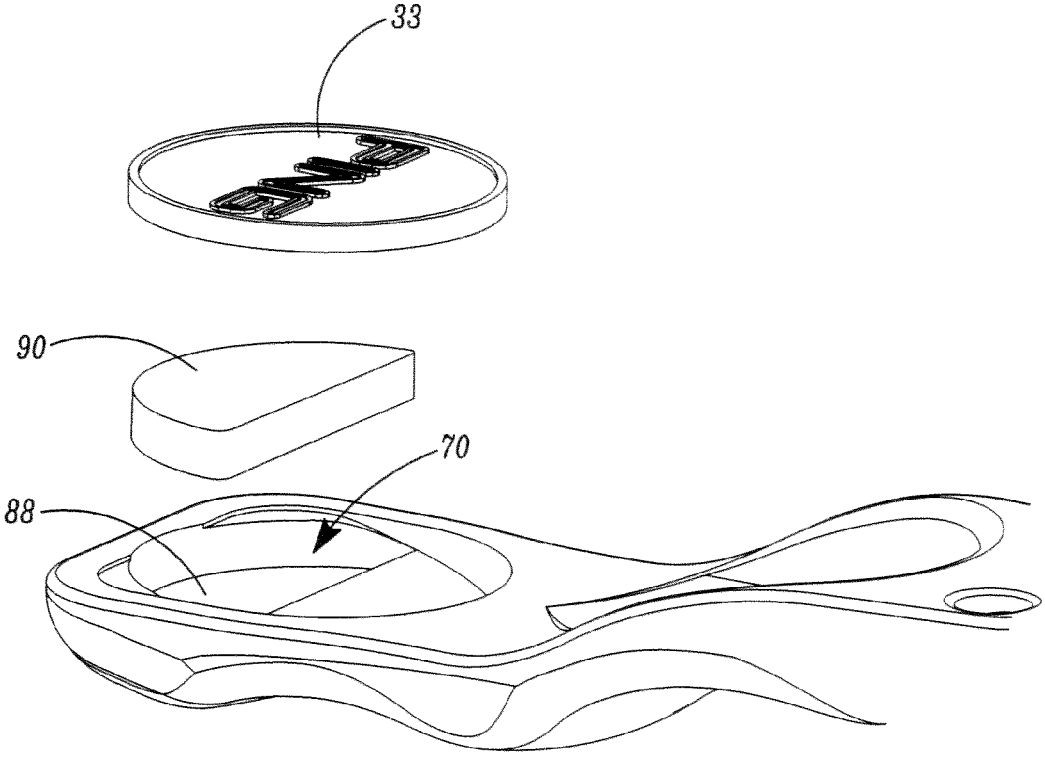
FIG. 13 is an exploded perspective view of a divot tool, a magnet and a ball marker according to another embodiment.
Figure 14:
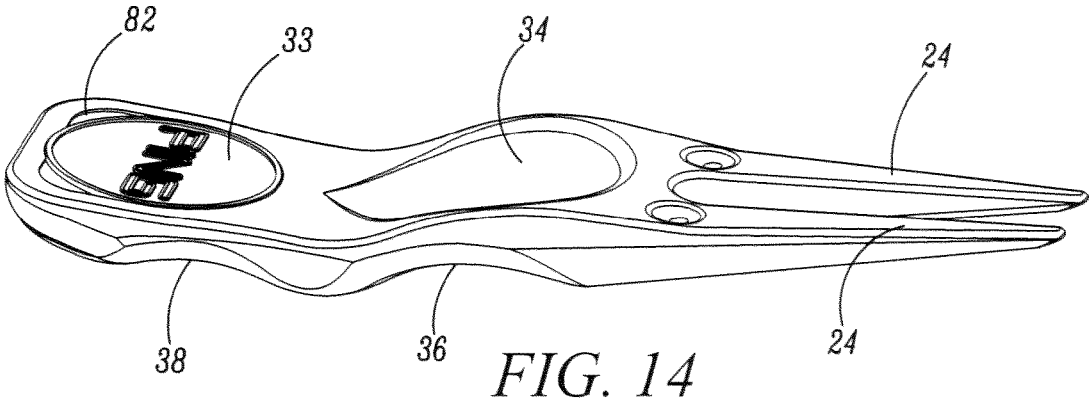
FIGS. 14-16 are perspective views of the divot tool of FIG. 1 showing removal of a ball marker from the divot tool.

Referring to FIGS. 9 and 10, the ball marker recess 30 is configured to hold a ball marker 33 therein. In the embodiment of FIGS. 11 and 13, the ball marker 33 is disc or coin shaped. However, in other embodiments, the ball marker 33 may be in any shape, such as rectangular, square, triangular, or polygonal. As shown in FIGS. 8 and 14, when the ball marker 33 is in the ball marker recess 30, the top surface of the ball marker 33 is positioned flush with the top surface of the divot tool 20 around the ball marker recess 30. Accordingly, the ball marker 33 does not project out of the ball marker recess 30, and therefore, does not interfere with an individual's use of the divot tool 20.

Referring to FIGS. 9 and 10, the ball marker recess 30 is formed by a first marker recess 70, which defines a stored position of the ball marker 33, and a second marker recess 72, which defines a removal position of the ball marker 33, which is a position prior to removal of the ball marker 33 from the ball marker recess 30. The first marker recess 70 includes a bottom surface 74 and a first recess wall 76 having a height generally corresponding to the thickness of the ball marker 33. The bottom surface 74 is also generally parallel to the first side 32 of the divot tool 20 surrounding the ball marker recess 30. Accordingly, when the bottom surface of the ball marker 33 is in contact with the bottom surface 74, the top surface of the ball marker 33 is flush with the first side 32 of the divot tool 20 surrounding the ball marker recess 30.

The second marker recess 72 includes a bottom surface 80 that is inclined relative to the bottom surface 74 of the first marker recess 72 so as to have a greater depth than the first marker recess 70. The ball marker recess 30 includes at least one ramp 82 on at least one side of the first marker recess 70. In the embodiment of FIGS. 9 and 10, the ball marker recess 30 includes two ramps 82 on laterally opposing sides of the first marker recess 72. The ramps 82 are positioned on the same plane that is defined by the bottom surface 80 of the second marker recess 72. Accordingly, the ramps 82 may be considered to be discontinuous extensions of the bottom surface 80 of the second marker recess 72. The ball marker recess 30 may also include a third recess 83 that are connected to the ramps 82 and inclined relative to the ramps 82. The third recess provides a transition from the ramps 82 to the top surface or the first side 32 of the divot tool around the ball marker recess 30.

Figure 12:
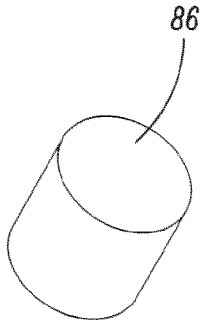
FIG. 12 is a perspective view of a magnet of a divot tool according to one embodiment.

In the exemplary embodiments of the divot tool 20 described herein, the first marker recess 70 includes a magnet recess 84 (shown in FIG. 10) for housing one or more magnets (generally shown as 36 in FIGS. 9 and 12). The ball marker 33 may include ferrous materials so that the ball marker 33 is attracted and held by the magnet 86 when the ball marker 33 is at or near the magnet 86. The ball marker 33 may be constructed from any material so long as the ball marker 33 can be attracted to the magnet 86. For example, the ball marker 33 may be constructed from steel or a plastic material having mixed therein iron particles. However, only a portion of the ball marker 33 at or near the bottom surface of the ball marker 33 may be constructed from a ferrous material. For example, an upper disc section of the ball marker 33 may be constructed from aplastic material without having any iron particles. Alternatively, the upper disc section may be constructed from a non-ferrous metal such as aluminum. A lower disc section of the ball marker 33 may be constructed from a ferrous material such as steel.

The upper surface and the lower surface of the ball marker 33 may have different or similar colors. Additionally the upper surface and the lower surface of the ball marker may include visual information such as a brand logo or any other indicia. The visual information may be drawn, etched, applied with an adhesive film or embossed onto the upper surface and/or the lower surface of the ball marker 33. The visual information may also be created during manufacturing of the ball marker 33. For example, if the ball marker 33 is stamped out of a piece of metal, the visual information can be embossed onto the ball marker 33 by the stamping press.

Referring to FIGS. 9 and 12, the magnet recess 84 may be cylindrical to house a correspondingly sized cylindrical magnet 86. The magnet 86 is sized and/or positioned in the magnet recess 84 so that the top of the magnet 86 is positioned flush with bottom surface 74 of the first marker recess 70. The magnet recess 84 may be in any shape and the magnet 86 may be sized and/or shaped correspondingly to be housed in the magnet recess 84 and to provide the function of maintaining the ball marker 33 in the stored position. For example, another embodiment of a magnet and its corresponding recess is shown in FIG. 13. In this embodiment, the first marker recess 70 is deeper to define a magnet recess 88 for accommodating a similarly shaped magnet 90. The thickness of the magnet 90 is such that when both the magnet 90 and the ball marker 33 are placed in the first marker recess 70, the top of the ball marker 33 is flush with the first side 32 of the divot tool 20 surrounding the ball marker recess 30. The magnet recesses 84 and 88 may be formed when the divot tool 20 is constructed. Subsequently, the magnet 86 or the magnet 90 may be attached in the magnet recess 84 or the magnet recess 88, respectively, by an adhesive by being press fit or other methods and materials that can be used to attach two parts together.

Alternatively, the magnet 86 or 90 may be fixed in the magnet recess 84 or the magnet recess 88, respectively, during a process for manufacturing the divot tool 20 as described in detail below. The magnet 86 or 90 may be a rare earth magnet.

Placement of the ball marker 33 in the stored position will now be described. The ball marker 33 can be placed in the stored position by being inserted into the first marker recess 70. Due to the presence of the magnet 86 or 90 in the first marker recess 70, when the ball marker 33 is positioned near the first marker recess 70, the ball marker 33 is pulled toward and inside the first marker recess 70. However, should the ball marker 33 not be perfectly pulled inside the first marker recess 70 such that a portion thereof is in the first marker recess 70 and the remaining portion thereof is outside the first marker recess 70, an individual can use his thumb or one or more of his other fingers to slide the ball marker 33 into the first marker recess 70. If the divot tool 20 is at least partly constructed from a ferrous material or includes iron particles, the portions of the divot tool 20 surrounding the magnet 86 or 90 may become magnetized. Accordingly, even if the ball marker 33 is placed near the first marker recess 70, the magnetized portions of the divot tool 20 around the ball marker recess 30 may attract the ball marker 33 and hold the ball marker 33 connected to the divot tool 20. An individual using the divot tool 20 can then use his thumb or one or more of his other fingers to slide the ball marker 33 into the first marker recess 70.

Figure 15:
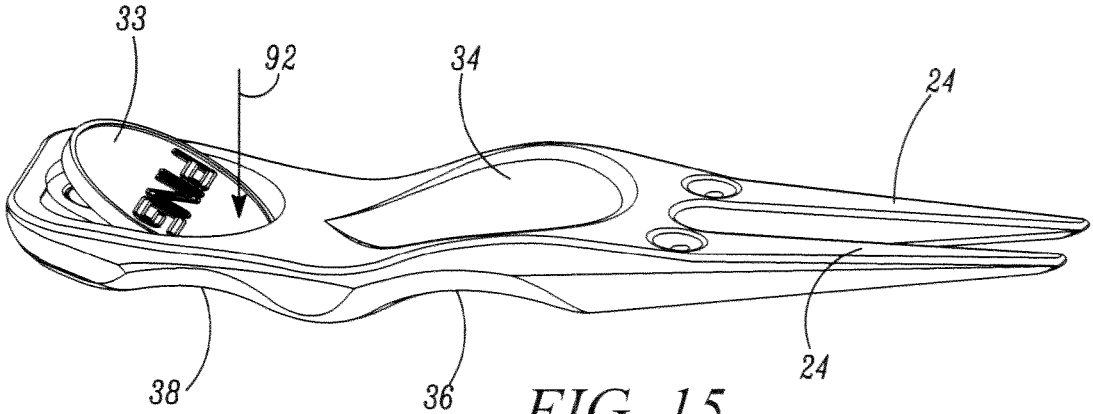
Figure 16:
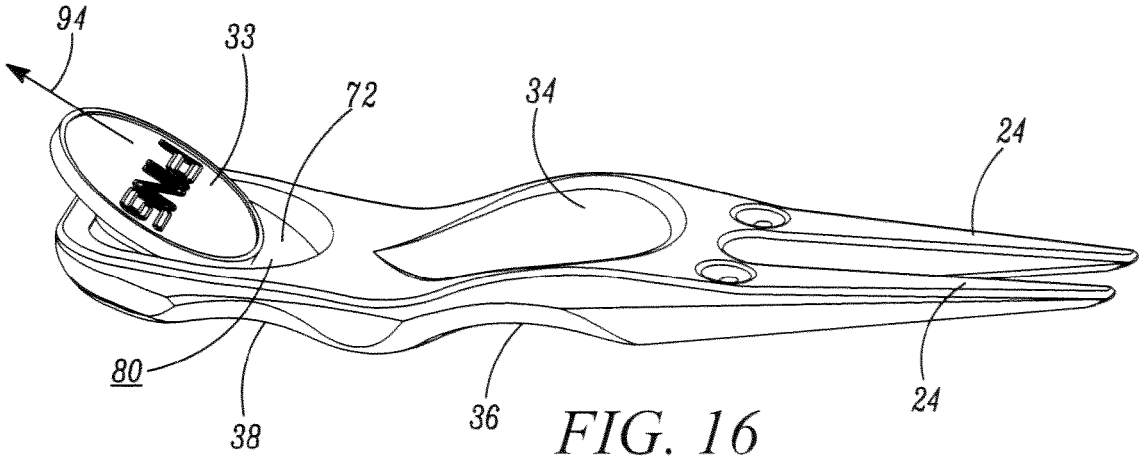

With reference to FIGS. 14-16, removal of the ball marker 33 from the ball marker recess 30 and placement thereof on the green will now be described. When placing the ball marker 30 on the green, the divot tool 20 is held by an individual with his left or right hand such that the end of the divot tool 20 nearest to the ball marker 33 is pointed toward the green and positioned near the green, while the barbs 24 are pointed away from the green. Accordingly and in an opposite manner to the divot repair process, an individual's index finger may be placed in the third finger recess 38 and the individual's middle finger may be placed in the second finger recess 36, with both fingers being wrapped around the second portion 26 of the divot tool 20. The barbs 24 may be at least partially positioned inside the palm of the individual's hand. The individual's thumb may be then positioned near the ball marker 33 with the tip of the individual's thumb facing the green. Once the divot tool 20 is in the above-described position, the individual can press down on the side of the ball marker 33 facing the second marker recess 72 in the direction of the arrow 92. This position of the ball marker 33 is shown in FIG. 15. The magnetic force of the magnet 86 or 90 may be sufficient in this position to attract the ball marker 33 back to the stored position if the individual removes his thumb from the ball marker 33 or reduces the force exerted on the ball marker 33.

In the position of the ball marker 33 shown in FIG. 15, the bottom surface of the ball marker 33 is in contact with the bottom surface 80 of the second marker recess 72 and the ramps 82. The plane defining the bottom surface 80 and the ramps 82 is oriented in the direction of the arrow 94, which is also the direction of removal of the ball marker 33 from the ball marker recess 30. Accordingly, the individual can slide the ball marker 33 along the inclined bottom surface 80 of the second marker recess 72 and the ramp 82 to remove the ball marker 33 from ball marker recess 30. Once the ball marker 33 is outside the ball marker recess 30, the individual can continue sliding the ball marker 33 on the divot tool 20 until the ball marker 33 is placed on the green. The divot tool 20 may be positioned close enough to the green so that the individual can just slide the ball marker 33 off the divot tool 20 and onto the green with his thumb. This sliding motion of the ball marker 33 from the divot tool 20 onto the green may provide accurate placement of the ball marker 33 onto the green. A forceful sliding or moving the ball marker 33 from the divot tool 20 onto the green may be necessary, because as described above, either the divot tool 20 may be sufficiently magnetized by the magnet 86 or 90, or the attraction force of the magnet 86 or 90 may be strong enough to keep the ball marker 33 connected to the divot tool 20 until the ball marker 33 is physically separated from the divot 20 by the individual's thumb sliding le ball marker 33 off the divot tool 20.

As described above, removal of the ball marker 33 from the divot tool 20 and the placement thereof on the green can be accomplished with only one finger, such as the thumb of an individual using the divot tool. Furthermore, the finger recesses 36 and 38 and the position of the barbs 24 at least partially inside the palm of the individual's hand provide sufficient grip for the individual while holding the divot tool 20, thereby allowing the individual to easily control the removal of the ball marker 33 from the ball marker recess 30 with only his thumb.

The divot tool 20 may be constructed from any type of material, such as stainless steel, aluminum, titanium, various other metals or metal alloys, composite materials, natural materials such as wood or stone, or plastic materials. If the divot tool 20 is constructed from metal, the divot tool 20 may be formed by stamping (i.e., punching using a machine press or a stamping press, blanking, embossing, bending, flanging, or coining, casting), injection molding, forging, machining or a combination thereof, or other processes used for manufacturing metal parts. If the divot tool 20 is constructed from plastic materials, divot tool 20 may be formed by injection molding or similar methods as those described above for making metal parts. With injection molding of metal or plastic materials, a one-piece or a multi-piece mold can be constructed which has interconnected cavities corresponding to the above-described parts of the divot tool 20. Molten metal or plastic material is injected into the mold, which is then cooled. During the injection molding process, the magnet 86 or 90 may be co-molded with the divot tool 20 rather than being affixed in the magnet recess 84 or 88, respectively, with an adhesive. The divot tool 20 is then removed from the mold and may be machined to smooth out irregularities on the surfaces thereof or to remove residual parts.

The finger recesses 36 and 38 and the first finger recess 34 may be textured during or after making the divot tool 20 to provide an enhanced frictional surface for the individual's fingers for a better grip. Other parts of the divot tool 20 may also be provided with such texturing or frictional enhancement to provide a better grip for the individual. In contrast, certain parts of the divot tool 20 may be manufactured to have smooth surfaces. For example, the surfaces that contact the ball marker 33 during the sliding motion thereof as described above can be smooth to facilitate a more effortless sliding of the ball marker 33. A mold for manufacturing the divot tool 20 as used herein generally refers to a part that is used to form at least a portion of the divot tool. Thus, all of the above-described processes for making the divot tool may use one or more molds. For example, the side of a stamping press that presses down on a piece of metal to form at least a portion of the divot tool 20 may be considered a mold The divot tool 20 may be constructed by connecting multiple pieces constructed from the same or different materials. For example, the first portion 22, which includes the barbs 24, may be constructed from aluminum to provide sufficient stiffness. The second portion 26 may be constructed from plastic and attached to the first portion 22. In one embodiment, the divot tool 20 may be constructed to have a core and a shell. The core may be constructed from a plastic material. The core is then encased in a shell. This process provides a divot tool 20 that is structurally stronger than a divot tool constructed from plastic, while lighter than a divot tool constructed from a very stiff material such as steel. Therefore, such a divot tool may provide both strength and light weight. The core may be encased by a metallic material with a process based on Nano-Nickel technology. Nano Nickel technology refers to nano-metal/polymer hybrid technology by which injection molded polymer substrates, such as any type of plastic material or Acrylonitrile Butadiene Styrene (ABS), are coated with a thin layer of ultra high strength metal. The metal coating gets its strength from its nanocrystalline grain structure and imparts this strength onto the substrate through its high strength interfacial bonds.

Figure 17:
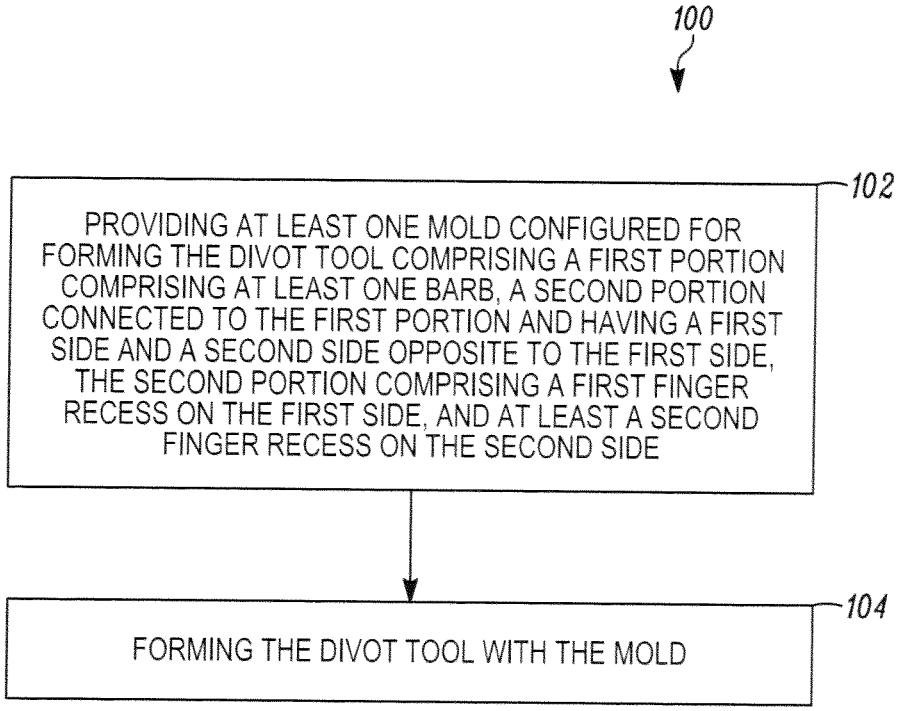
FIG. 17 is a flowchart showing a method of making a divot tool according to one embodiment.

Based on the above described exemplary methods of making a divot tool, one exemplary method 100 of making a divot tool is shown in FIG. 17. At 102 a mold is provided for making a divot tool 20 or a core of the divot tool, where the mold includes recesses and projections that correspond to the barbs 24, the first finger recess 34 and the finger recesses 36 and 38, respectively. The mold may also include a projection corresponding the ball marker recess 30. Furthermore, the mold may also include a projection corresponding to the magnet recess 84 or 88. At 104, the divot tool 20 is formed with the mold as described in detail above. If only the core is formed at 104, the core may be encased in a shell as described above. The magnet 86 or 90 can then be placed in the magnet recess 84 or 88, respectively. Alternatively, the magnet 86 or 90 may be co-manufactured with the divot tool 20 as described above. After the divot tool 20 is formed having the ball marker recess 30 and a magnet 88 or 90, a ball marker 33 is then placed in the ball marker recess 30 in the stored position. Prior to placing the ball marker 33 in the ball marker recess 30, the ball marker 33 may be manufactured by one or more of the processes described in detail above.

Although a particular order of actions is illustrated in FIG. 17, these actions may be performed in other temporal sequences. For example, two or more actions depicted in FIG. 17 may be performed sequentially, concurrently, or simultaneously. Alternatively, two or more actions depicted may be performed in reversed order. Further, one or more actions depicted in FIG. 17 may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A divot tool comprising:

a ball marker;

a first portion having at least one barb;

a second portion connected to the first portion and comprising a ball marker recess and a first finger recess between the at least one barb and the ball marker recess, the ball marker recess comprising:

a first marker recess comprising a bottom surface;

a second marker recess comprising a bottom surface inclined relative to the bottom surface of the first marker recess; and at least one ramp disposed outside the second marker recess and being substantially in a same plane as the bottom surface of the second marker recess;

wherein the ball marker is moveable from a stored position disposed in the first marker recess to a removal position being slidable on the bottom surface of the second marker recess and the at least one ramp.

2. The divot tool of claim 1, further comprising:

a second finger recess on the second side opposite the first side; and a third finger recess adjacent the second finger recess.

3. The divot tool of claim 2, wherein each of the second finger recess and the third finger recess is defined by a concave depression on the second side.

4. The divot tool of claim 1, wherein the first finger recess comprises a bottom surface extending from a first end of the first finger recess to a second end of the first finger recess and a substantially vertical wall at the second end defining a largest depth of the first finger recess, wherein the depth of the first finger recess increases from the first end to the second end.

5. The divot tool of claim 1, further comprising a magnet disposed in the ball marker recess, wherein the ball marker comprises a ferrous material, and wherein the magnet attracts the ball marker and holds the ball marker in the hall marker recess.

6. The divot tool of claim 1 further comprising a core constructed from a first material and a shell, constructed from a second material.

7. The divot tool of claim 1, further comprising a second finger recess defined by a concave depression on the second side.

8. A method of making a divot tool comprising:

forming a first portion having at least one barb; and forming a second portion connected to the first portion and comprising a ball marker recess and a first finger recess between the at least one barb and the ball marker recess, the ball marker recess comprising a first marker recess comprising a bottom surface, a second marker recess comprising a bottom surface inclined relative to the bottom surface of the first marker recess, and at least one ramp disposed outside the second marker recess and being substantially in a same plane as the bottom surface of the second marker recess;

wherein a ball marker is moveable from a stored position disposed in the first marker recess to a removal position being slidable on the bottom surface of the second marker recess and the at least one ramp.

9. The method of claim 8, further comprising:

forming a second finger recess on the second side opposite the first side; and forming a third finger recess adjacent the second finger recess.

10. The method of claim 8, further comprising forming a second finger recess on the second side opposite the first side; and forming a third finger recess adjacent the second finger recess;

wherein each of the second finger recess and the third finger recess is defined by a concave depression on the second side.

11. The method of claim 8, wherein the first finger recess comprises a bottom surface extending from a first end of the first finger recess to a second end of the first finger recess and a substantially vertical wall at the second end defining a largest depth of the first finger recess, wherein the depth of the first finger recess increases from the first end to the second end.

12. The method of claim 8, further comprising providing a magnet in the ball marker recess, wherein the ball marker comprises a ferrous material, and wherein the magnet attracts the ball marker and holds the ball marker in the ball marker recess.

13. The method of claim 8, wherein forming the first portion and the second portion comprises forming a core constructed from a first material and a shell constructed from a second material.

14. The method of claim 8, further comprising forming a second finger recess defined by a concave depression on the second side.

* * * * *